United States Patent [19]

Jones et al.

[11] Patent Number: 5,056,587

[45] Date of Patent: Oct. 15, 1991

[54] METHOD FOR DESLAGGING A BOILER

[75] Inventors: Linza J. Jones, Alvarado, Tex.; Richard N. Willis, Bossier City, La.

[73] Assignees: Halliburton Company, Duncan, Okla.; Jet Research Center, Inc., Alvarado, Tex.

[21] Appl. No.: 637,961

[22] Filed: Jan. 9, 1991

Related U.S. Application Data

[63] Continuation of Ser. No. 579,466, Sep. 7, 1990, abandoned, which is a continuation-in-part of Ser. No. 545,242, Jun. 28, 1990, abandoned, which is a continuation of Ser. No. 450,206, Dec. 12, 1989, abandoned.

[51] Int. Cl.[5] ..... F28D 11/06

[52] U.S. Cl. ..... 165/1; 122/379; 134/1; 165/84

[58] Field of Search ..... 165/1, 84; 122/379; 134/1

[56] References Cited

U.S. PATENT DOCUMENTS

| | | | |
|---|---|---|---|
| Re. 32,723 | 8/1988 | Neundorfer . | |
| 3,180,418 | 4/1965 | MacLeod . | |
| 3,285,778 | 11/1966 | Hauk . | |
| 3,481,784 | 12/1969 | Karpovich . | |
| 3,721,297 | 3/1973 | Challacombe . | |
| 3,835,817 | 9/1974 | Tuomaala . | |
| 4,089,702 | 5/1978 | Enoksson et al. . | |
| 4,120,699 | 10/1978 | Kennedy, Jr. et al. . | |
| 4,167,209 | 9/1979 | Simpson . | |
| 4,485,718 | 12/1984 | Furmanski et al. . | |
| 4,497,282 | 2/1985 | Neundorfer . | |
| 4,595,048 | 6/1986 | Pollak et al. . | |
| 4,741,292 | 5/1988 | Novak . | |
| 4,757,863 | 7/1988 | Challacombe et al. . | |
| 4,880,335 | 11/1989 | Lee . | |
| 4,893,588 | 1/1990 | Jekerle et al. | 165/84 X |
| 4,898,197 | 2/1990 | Barry et al. . | |
| 4,898,650 | 2/1990 | Wu et al. . | |
| 4,920,994 | 5/1990 | Nachbar . | |

FOREIGN PATENT DOCUMENTS

| | | |
|---|---|---|
| 2033995A | 5/1980 | United Kingdom . |

OTHER PUBLICATIONS

MPC Explosives Team, undated.

Newspaper column "St. Louis Sun", undated.

*Primary Examiner*—Edward G. Favors

*Attorney, Agent, or Firm*—Arnold, White & Durkee

[57] ABSTRACT

A method for removing accumulated ash from the heat exchangers within a steam generator includes introducing a series of high-energy shocks to the tubing panels of the heat exchangers. Explosive cords are attached to the tubing panels at preselected, spaced-apart locations and separately detonated at preselected intervals to establish a vibratory pattern in the tubing panels and thereby separate the ash from the tubing panels.

13 Claims, 8 Drawing Sheets

METHOD FOR DESLAGGING A BOILER

CROSS REFERENCE TO RELATED APPLICATION

This application is a continuation of Ser. No. 07/579,466 filed Sept. 7, 1990, now abandoned which is a continuation-in-part of U.S. Pat. Application Ser. No. 545,242 filed June 28, 1990, now abandoned which is a continuation of U.S. Pat. Application Ser. No. 450,206 filed Dec. 12, 1989, now abandoned.

BACKGROUND OF THE INVENTION

1. Field of the Invention

This invention relates generally to a method for cleaning the exterior surface of tubing located within the interior of a steam generator of the type ordinarily employed to produce large volumes of steam utilized to generate electricity. The invention more particularly relates to a method for removing the accumulation of ash from the exterior surfaces of the tubes and, still more particularly, to a method of using explosive detonating cord to produce controlled, sequential explosions whereby pressure waves and vibrations of the tubing are established to effect separation of the ash from the tubing.

2. Related Art and Problems Solved

Electric power generating plants commonly produce steam to operate turbines which in turn operate generators to produce electricity. The steam is produced by heating the external surfaces of tubing containing water wherein the tubing is housed in large structures referred to as steam generators. Commonly, the heat is provided by the combustion in the steam generator of gas, oil, coal, or other hydrocarbon fuels. Combustion of hydrocarbon fuels not only produces heat but also produces large amounts of solid waste material which is sometimes referred to herein as ash and sometimes as slag. Coal dust is a common hydrocarbon fuel source which contains numerous impurities that are not efficiently burned and also show up as solid waste material. Ash collects on the exterior surfaces of the tubing and acts as an insulative layer on the tubing.

It should be appreciated that this insulative layer reduces the overall efficiency of the steam generator by requiring additional combustion of fuel to properly heat the water within the tubes. In fact, when the tubing is properly cleaned, that is, when the insulative layer is removed, the thermal efficiency of the plant can be expected to increase by approximately 0.5% to 1%. When the enormous scale of a typical steam generator is considered, this relatively small percentage increase results in an extremely large dollar savings to the operating company.

Accordingly, it is known in the art to periodically clean a steam generator by a process featuring extensive washing of the ash with a high-pressure water solution; the process is commonly referred to as hydroblasting. Typically, hydroblasting involves such inherent problems as requiring a complete shut-down of the steam generator for as long as twenty days. Obviously, complete shut-down of the steam generator means that it cannot be doing what it is designed to do, produce steam to generate electricity.

During the period required to perform the hydroblasting, a crew of approximately sixteen people work twenty-four hours per day in relatively cramped and undesirable working conditions. The twenty-four hour per day requirement is a byproduct of using water as the cleaning agent. The combination of the water and ash can produce a cementitious like material, which, if allowed to dry, would also harden like cement and further exacerbate the clean-up. Accordingly, the ash removal work must proceed around the clock with prompt attention to removing the wet ash.

Moreover, while a steam generator typically includes provisions for removing dry ash that settles to the bottom of the generator, it is not equipped to handle wet ash. Therefore, a hydroblasting operation requires the use of expensive, wet-ash-handling equipment, as well as the extensive manpower required to operate it.

An additional byproduct of a hydroblasting operation is the production of sulfuric acid. The water combines with sulfuroxide in the ash to produce an acid that is highly corrosive to the tubing, as well as to any other metallic structure in the facility. Thus, careful attention must be given to the dilution or removal of the sulfuric acid to prevent undesirable corrosion and attendant repair of the facility.

The present invention is directed to overcoming one or more of the problems set forth above.

SUMMARY OF THE INVENTION

One object of the present invention is to provide a method for separating ash from the tubing arrays of a steam generator via a dry process.

Another object of the present invention is to provide a method for separating ash from the tubing arrays of a steam generator by delivering a series of high-energy shocks to the tubing arrays.

Yet another object of the present invention is to provide a method for separating ash from the tubing arrays of a steam generator by producing a series of controlled, sequential detonations throughout the tubing arrays.

To attain these and other objects, a method is provided for separating ash from the exterior surfaces of tubing located in a steam generator. The method includes the steps of: placing a plurality of explosive detonating cords at preselected locations throughout said steam generator immediately adjacent the exterior surface of said tubing; and detonating said plurality of explosive detonating cords in a preselected sequence, whereby pressure waves and vibrations of said tubing are established and the ash separates therefrom.

In another aspect of the present invention, a method is provided for separating ash from the exterior surfaces of tubing located in a steam generator. The method includes the steps of: placing a plurality of explosive detonating cords at preselected locations throughout said steam generator immediately adjacent the exterior surfaces of said tubing; and detonating each of said explosive detonating cords at a separate time, with a preselected delay between each detonation, whereby pressure waves and vibrations of said tubing are established to effect separation of the ash therefrom.

In another aspect of the present invention, a method is provided for removing ash from the exterior surfaces of tubing located in a steam generator. The method includes the steps of: determining the wall thickness of said tubing; selecting the explosive force of a plurality of explosive detonating cords as a function of the wall thickness of said tubing; placing said plurality of explosive detonating cords at preselected locations throughout said steam generator immediately adjacent the exterior surface of said tubing; detonating each of said explosive detonating cords at a separate time, with a preselected delay between each detonation, whereby pressure waves and vibrations of said tubing are established and the ash separates therefrom; and removing the ash separated from said tubing.

BRIEF DESCRIPTION OF THE DRAWINGS

Other objects and advantages of the invention will become apparent upon reading the following detailed description and upon reference to the drawings in which:

FIG. 2A is a side view of FIG. 2 illustrating a vertical tubing array consisting of a plurality of tubing panels each having an explosive detonating cord attached thereto;

FIG. 3A is a top view of FIG. 3 looking in the direction of line 3A—3A illustrating a horizontal tubing array consisting of a plurality of tubing panels showing connections between adjacent explosive detonating cords and the means of detonation of each cord;

The invention is susceptible to various modifications and alternative forms, but specific preferred embodiments thereof have been shown by way of example in the figures and are herein described in detail. It should be understood, however, that the figures and descriptions are not intended to limit the invention to the particular embodiments disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 1:
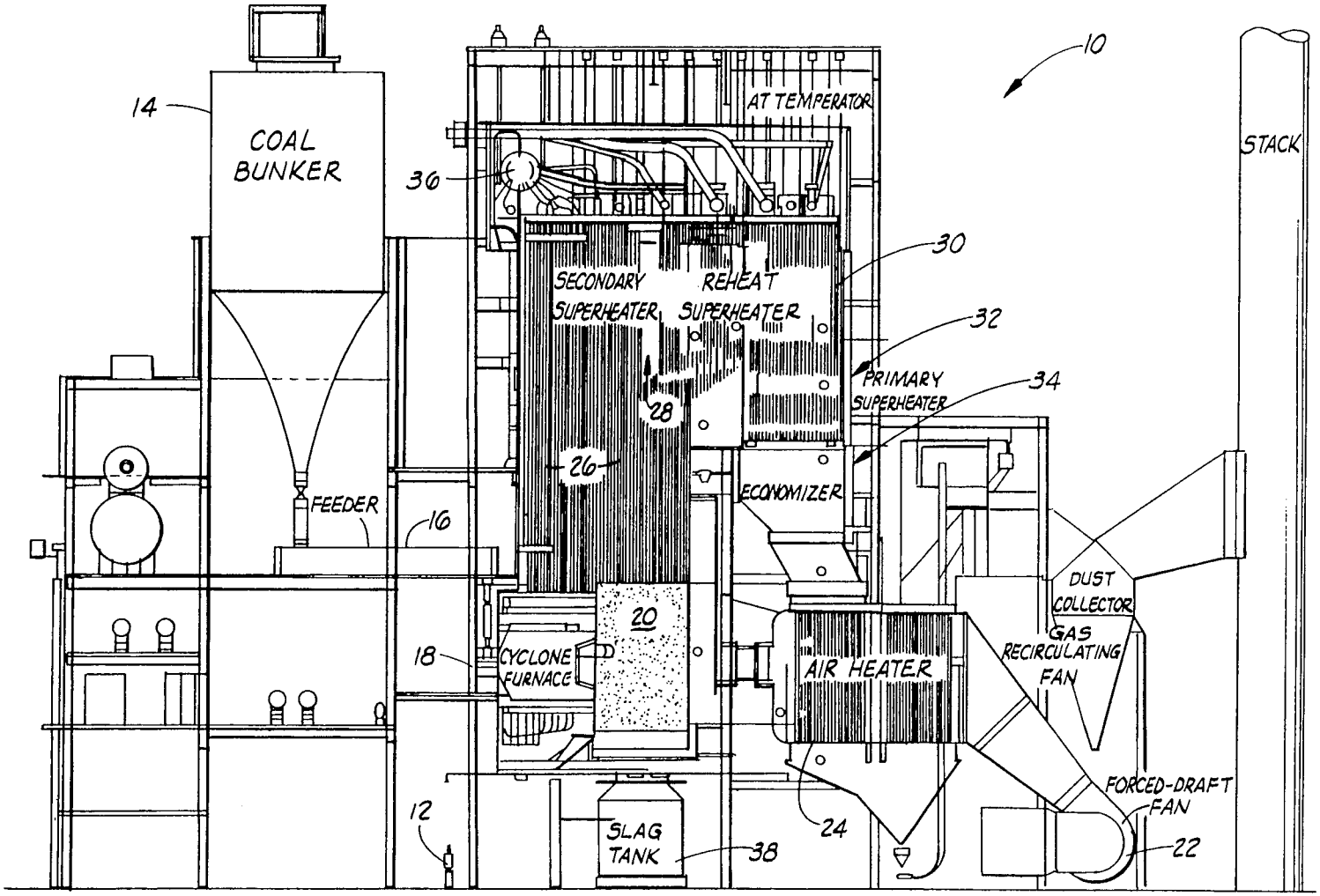
FIG. 1 illustrates a cross sectional view of a typical steam generator.

For a proper appreciation of the operation of the instant invention, refer first to the structure and operation of a typical steam generator. Referring to FIG. 1, a cross sectional view of such a typical steam generator 10 is illustrated. The entire facility is approximately 175 feet tall and 125 feet wide. The size of such a facility and the attendant difficulty in cleaning one may be better appreciated when its size relative to that of an ordinary man is considered. For example, an average man 12 is shown substantially to scale standing at a lowest level of the facility. Thus, it can be appreciated that such units are extremely large and the process of cleaning one is a complicated and time consuming process.

A reserve of coal is supplied into a coal bunker 14 where the coal is prepared for delivery into the furnace portion of the steam generator. A feeder 16 receives the coal from the coal bunker 14, pulverizes it, and injects it into a cyclone furnace 18. The cyclone furnace 18 injects the coal dust into a burner box 20 where the coal dust is ignited into a fireball, thereby providing the source of heat to convert liquid water into steam to drive steam turbines (not shown) so as to produce electricity.

The burning coal dust does not directly heat the water, but rather, provides an indirect heating of the water by radiation and convection means. A forced-draft fan 22 pumps air through an initial air heater 24 and into the burner box 20. The hot combustion gases rise generally vertically along the lines indicated by element number 26 and pass through a series of heat exchangers 28, 30, 32 and 34. Combustion gas following path 26 contains ash that results from burning the coal dust in the burner box 20. Therefore, ash can accumulate on the exterior surfaces of the heat exchangers 28, 30, 32 and 34 to thereby reduce the ability of the heat exchangers to transfer heat owing to the insulative properties of the ash.

Not all of the ash collects on the heat exchangers 28, 30, 32 and 34, because a portion of the ash simply settles out of the combustion gas while it is still in burner box 20 and accumulates in the bottom of the steam generator. Thus, a slag tank 38 is positioned immediately below burner box 20 to receive this ash product. Clearly, the facility has procedures in place for periodically removing the ash from slag tank 38. Thus, during the cleaning process of this invention, a large portion of the ash separated from the heat exchangers 28, 30, 32 and 34 falls into the slag tank 38 and can be removed therefrom using the facilities standard procedures.

Figure 1A:
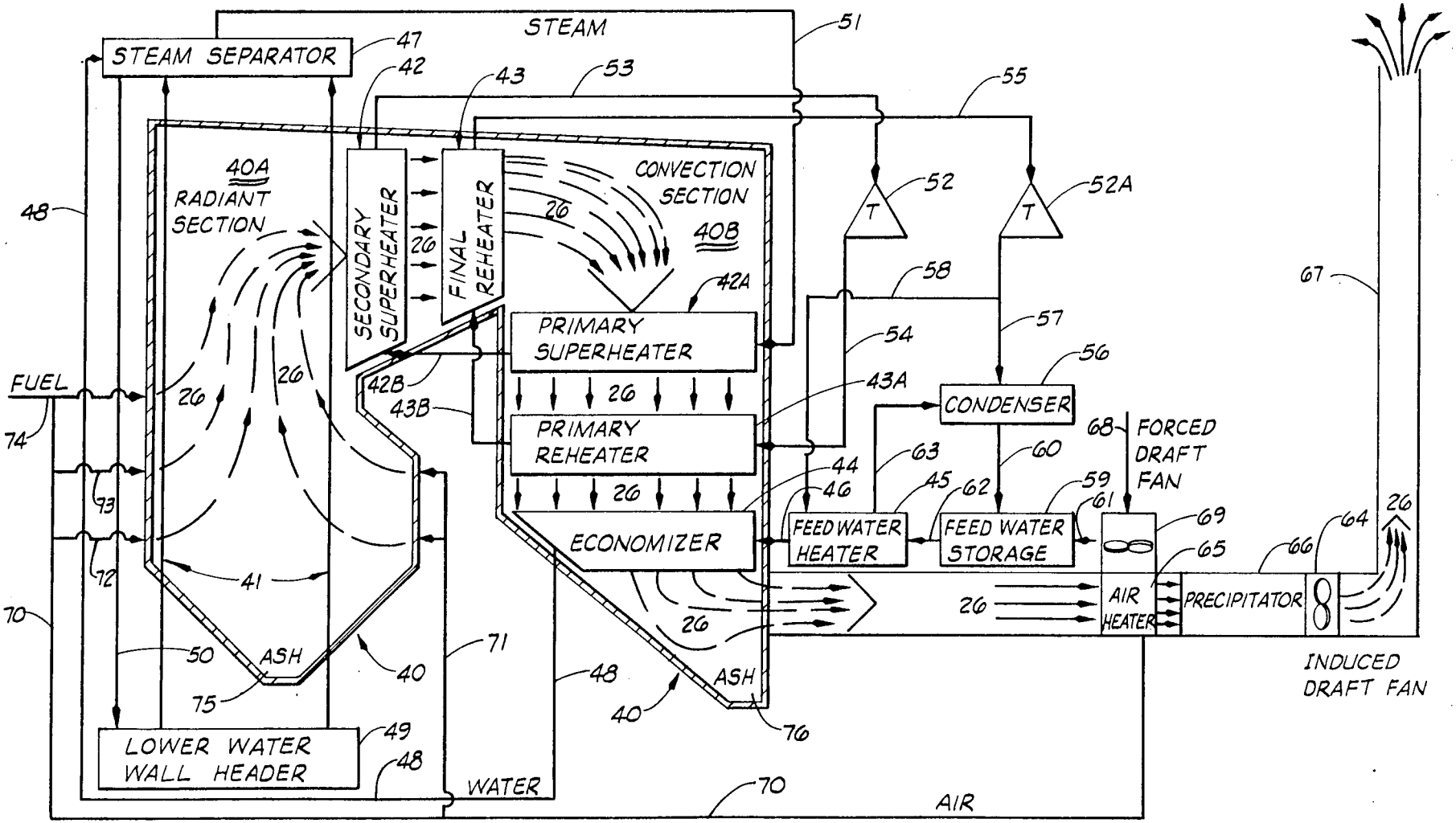
FIG. 1A is a schematic diagram of a typical natural circulation steam generator and associated, turbines and feed water systems.

Referring now to FIG. 1A, a schematic diagram of a typical natural circulation steam generator, it will be apparent to a person skilled in the art of electric power generation that water in the form of superheated steam utilized in the steam turbines to produce electricity ideally circulates in a closed system. The schematic thus illustrates a closed loop system, but persons skilled in the art know well that water losses do occur and provisions to replace water losses, although not specifically illustrated in FIG. 1A, are actually included in commercial steam generators.

In operation a steam generator as shown in FIGS. 1 and 1A converts water from the liquid phase to saturated steam and then to superheated steam. The superheated steam then converts much of its energy to the production of electricity by turning a turbine which is connected to an electric generator. The expended steam is then condensed to water in the liquid phase and the cycle is repeated.

A steam generator, in general, includes various arrays of boiler tubes containing water. The water exists in two distinct physical phases. The heating process is conducted in an enclosed volume 40 containing hot gases produced by the combustion of hydrocarbon fuels such as coal, oil or natural gas. Volume 40 is comprised of two principle heat transfer sections which are a radiation section 40A and a convection section 40B. Accordingly, the principle means of heat transfer in the steam generator is by radiation in section 40A and by convection in section 40B. The combustion gases, come into direct contact with the tubing in each array which by heat transfer mechanism results in the heating of the water.

The usual tubing arrays enclosed within volume 40 include a plurality of water wall tubes 41 which, as the name suggests, form a vertical wall-like enclosure which can be several tubes thick generally located along the interior boundaries of volume 40A surrounding the combustion zone (identified as burner box 20 in FIG. 1). FIG. 1A shows only two tubes marked by numeral 41, but in reality there are many such tubes spaced closely together to form a seemingly solid wall. Included within volume 40B are several tubing arrays generally designated as secondary super heater 42, primary super heater 42A, final reheater 43, primary reheater 43A and economizer, 44. Within radiation section 40A, the water in tubes 41 is in the liquid phase and at the boiling point. Within convection section 40B the water in tube arrays 42, 42A, 43 and 43A is in the gas phase and is classed generally as superheated steam and water in economizer 44 is in the liquid phase.

In operation, water, in liquid phase, passes from feed water heater 45 to economizer 44 via conduit 46. The water undergoes heating in economizer 44 and then passes, still in liquid phase, to steam separator 47 via conduits 48. (Steam separator 47 is identified in FIG. 1 by numeral 36.) Steam separator 47 functions, in part, as a phase separation device wherein water in the liquid phase is separated from steam. Liquid water is permitted to pass from steam separator 47 to lower water wall header 49 via large conduits 50, called downcomers; saturated steam is permitted to pass from steam separator 47 to primary superheater array 42A via conduit 51. Water in the liquid phase is passed from lower water wallheader 49 to steam separator 47 via water wall tubes 41, wherein water in the liquid phase is heated primarily by radiation and converted into saturated steam.

Figure 3B:
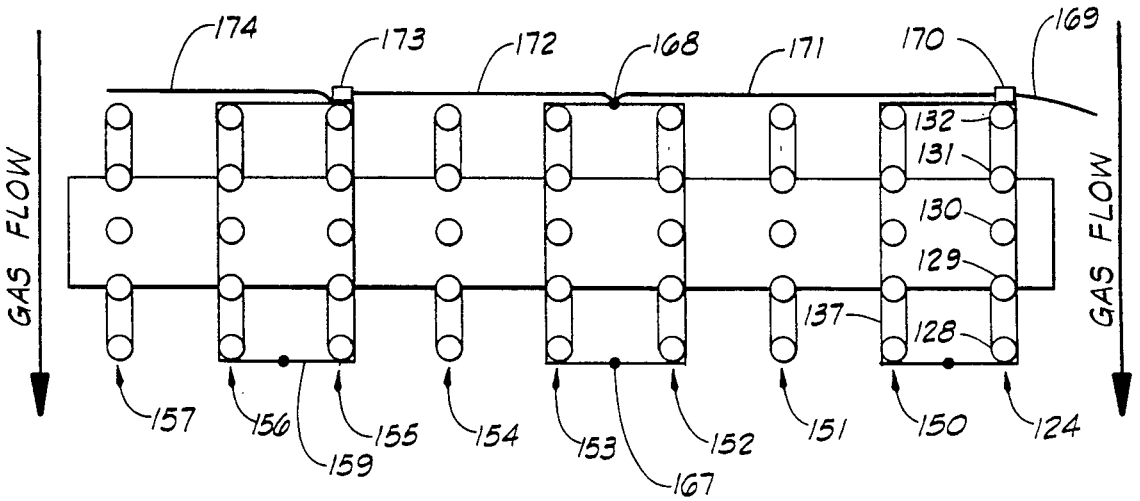
FIG. 3B is a partial side view of FIGS. 3 and 3A along line 3B—3B of FIGS. 3 and 3A illustrating a partial view of a horizonal tubing array showing a plurality of tubing panels and explosive detonating cord attached to the panels.
Figure 3:
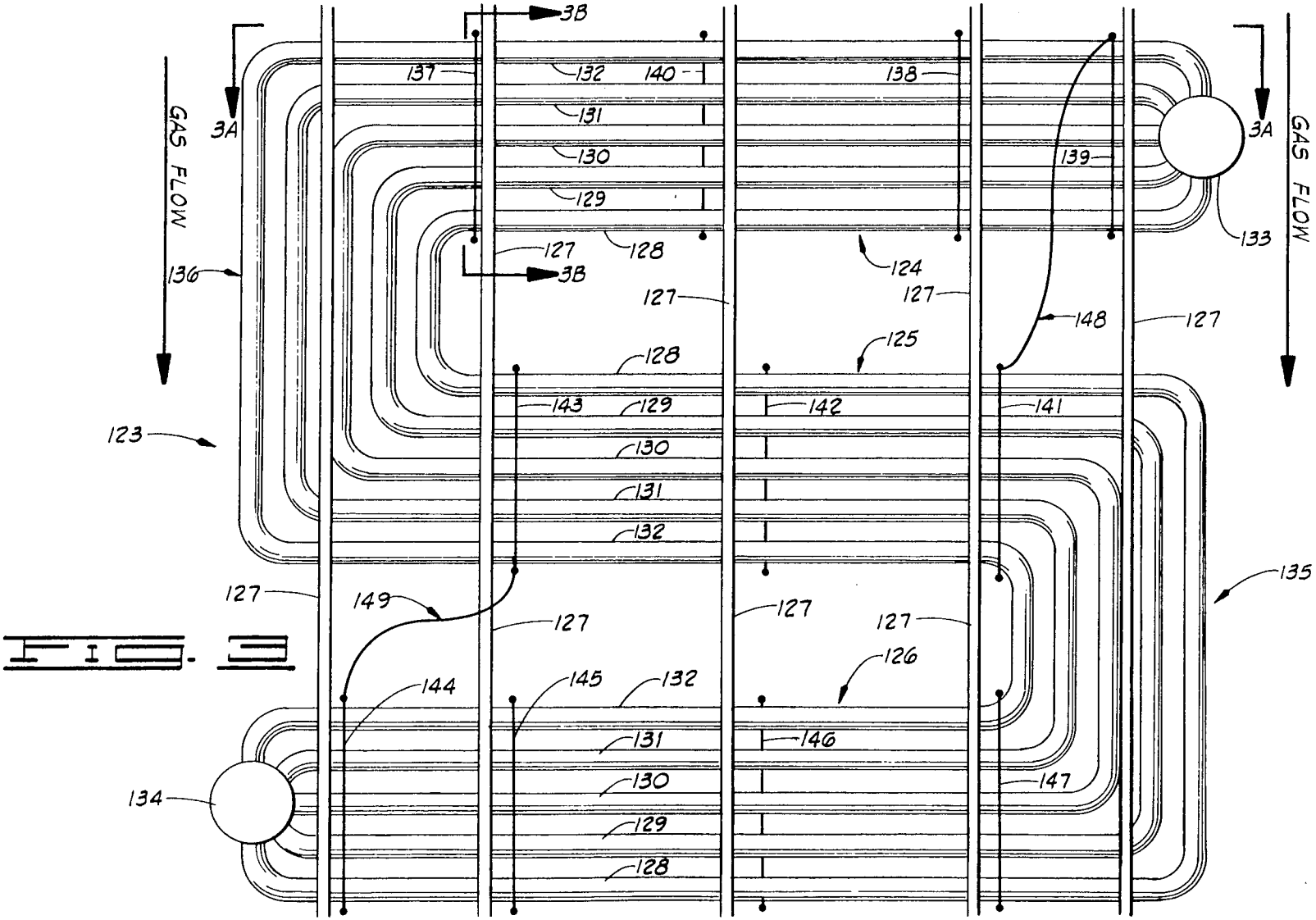
FIG. 3 illustrates a front view of a horizontal tubing panel contained within a typical steam generator with a series of explosive detonating cords attached thereto.
Figure 3:
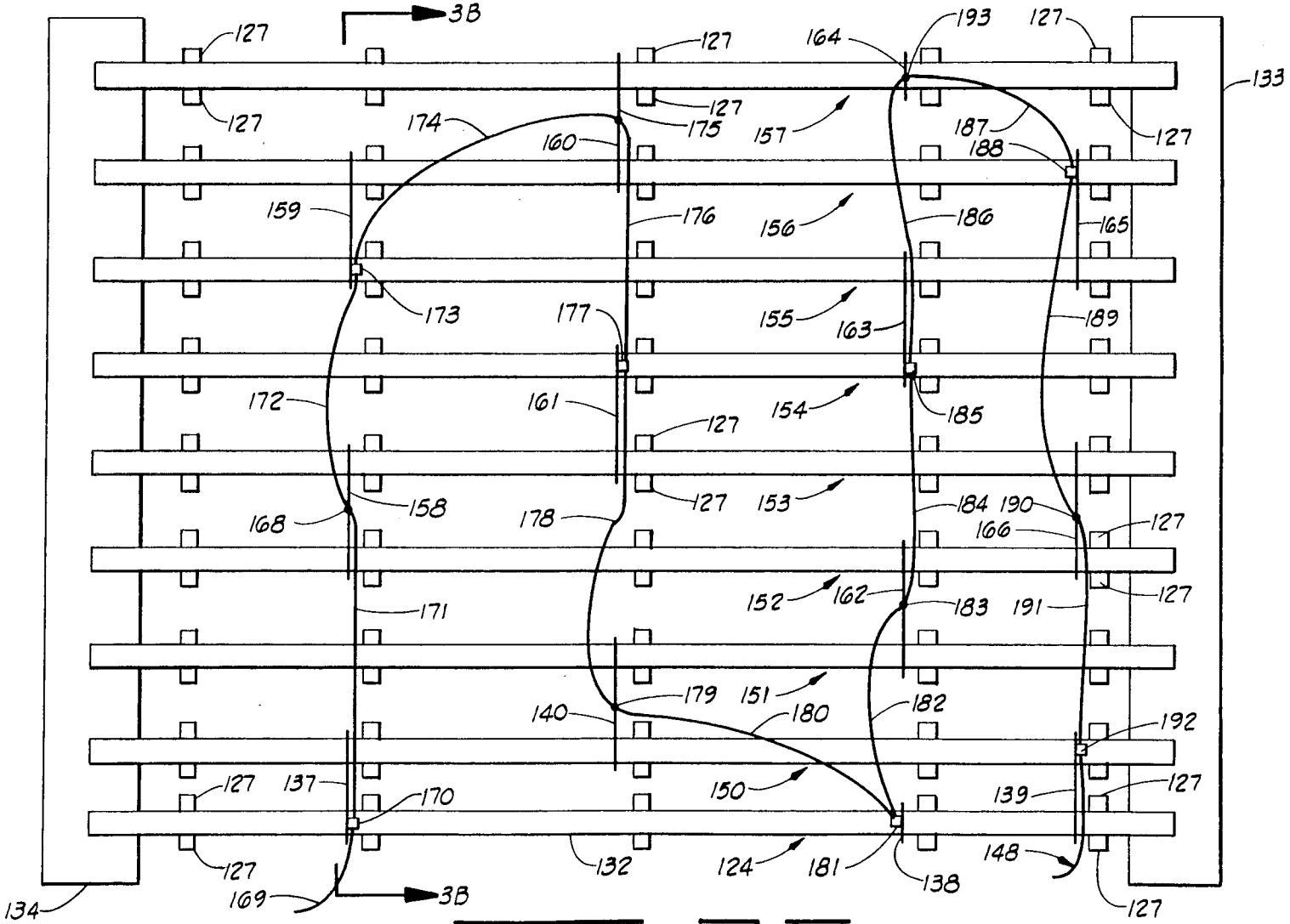

As previously described saturated steam is permitted to pass from steam separator 47 via conduit 51 to primary superheater array 42A located in convection section 40B wherein heat from the combustion gases is transferred by convection to the saturated steam to produce superheated steam. Primary superheater 42A is a horizontal tubing array such as is illustrated in FIGS. 3, 3A and 3B. (As mentioned above in connection with FIG. 1) combustion gases following path 26 pass through primary superheater 42A in a generally vertically down direction. Ash carried in the combustion gas can adhere to the exterior of the tubes contained in array 42A to thus disrupt the heat transfer to the tubes and also to disrupt the passage of the gas itself through the array.

Figure 2:
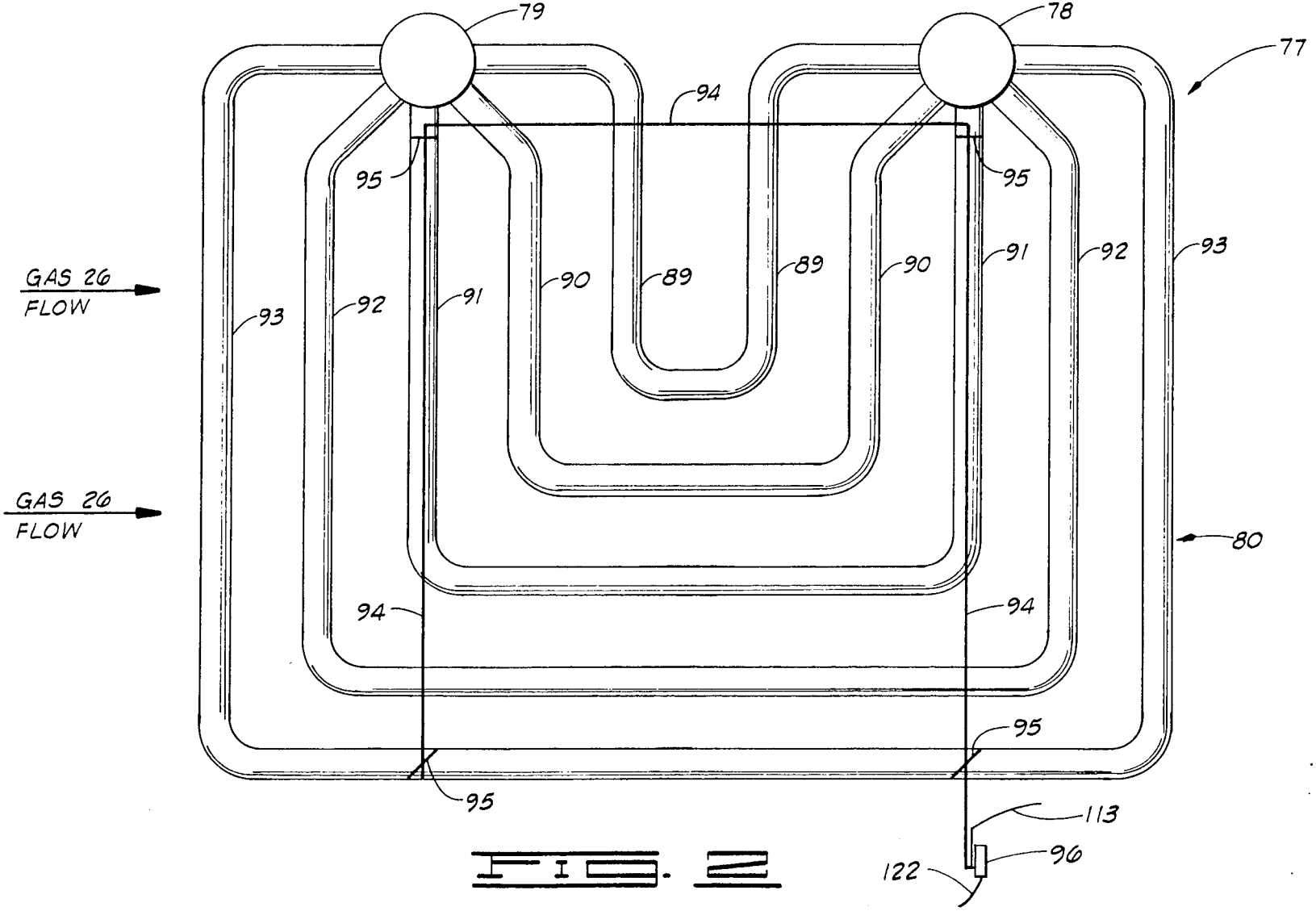
FIG. 2 illustrates a front view of a vertical tubing panel contained within a typical steam generator with an explosive detonating cord attached thereto.
Figure 24:
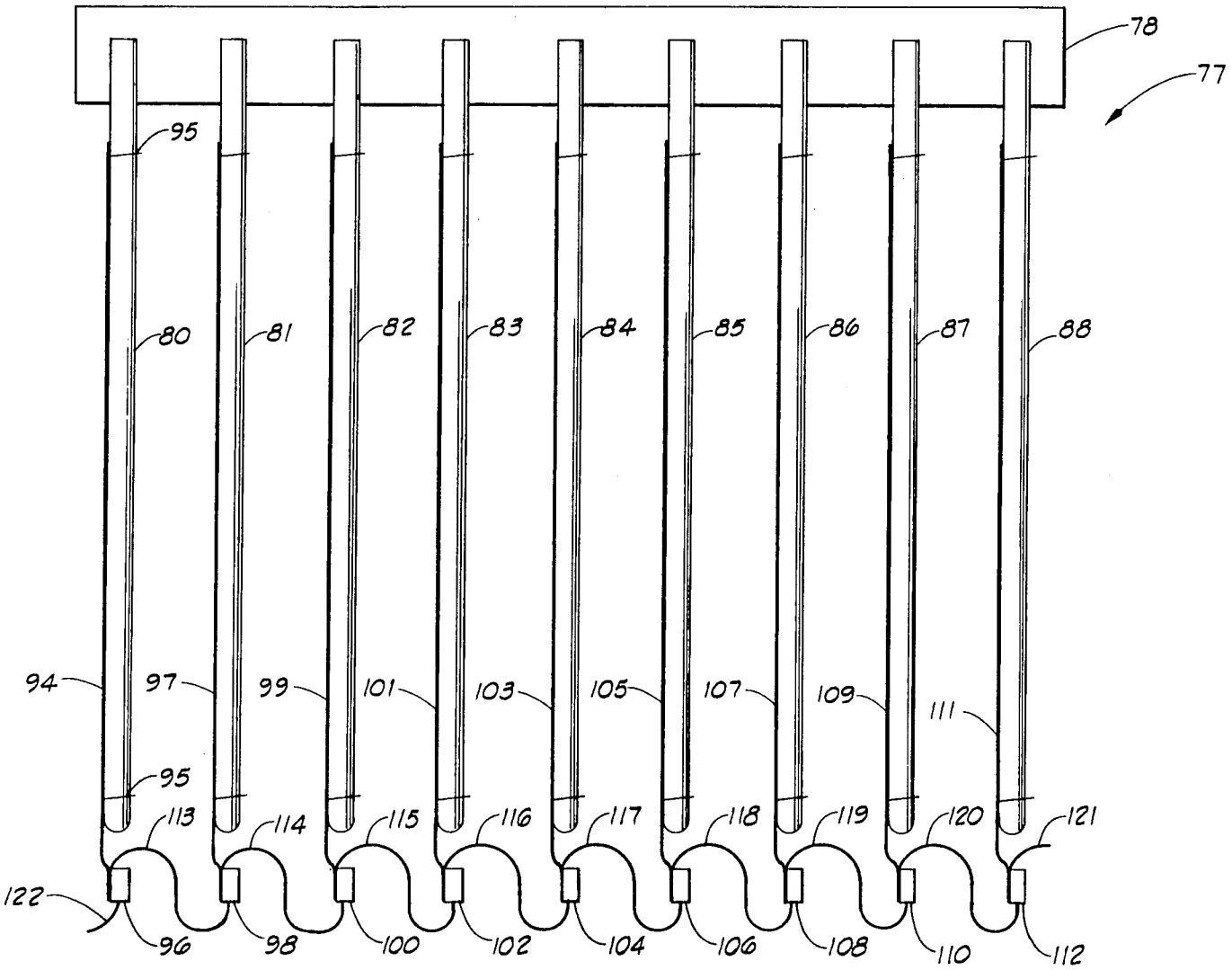

Superheated steam is then permitted to pass from primary superheater 42A to secondary superheater 42 via conduit 42B located between radiation section 40A and convection section 40B wherein the steam temperature and pressure is increased to substantially the levels required to operate high pressure turbine 52. Secondary superheater 42 is a vertical tubing array—sometimes called a pendent array—such as is illustrated in FIGS. 2 and 2A. (As mentioned above in connection with FIG. 1) combustion gases following path 26 pass through secondary superheater 42 in a generally horizontal direction. Ash carried in the combustion gas can adhere to the exterior of the tubes contained in array 42 to thus disrupt the heat transfer to the tubes and also to disrupt the passage of the gas itself through the array.

Superheated steam is then passed to turbine 52 via conduit 53 wherein the steam is used to operate the turbine 52. The steam now at a reduced energy level which may be close to saturated level, is passed from turbine 52 to primary reheater, 43A which is within convection section 40B via conduit 54, wherein the energy level of the steam is increased. Primary reheater 43A is a horizontal tubing array such as is illustrated in FIGS. 3, 3A and 3B. (As mentioned above in connection with FIG. 1) combustion gases following path 26 pass through primary reheater 43A in a generally vertically down direction. Ash carried in the combustion gas can adhere to the exterior of the tubes contained in array 43A to thus disrupt the heat transfer to the tubes and also to disrupt the passage of the gas itself through the array.

Superheated steam from primary reheater 43A is then passed to final reheater 43 which is within convection section 40B via conduit 43B. The steam in final reheater 43 is substantially increased to the temperature and pressure levels required to operate turbine 52A.

Final reheater 43 is a vertical tubing array—sometimes called a pendent array—such as is illustrated in FIGS. 2 and 2A. (As mentioned above in connection with FIG. 1) combustion gases following path 26 pass through final reheater 43 in a generally horizontal direction. Ash carried in the combustion gas can adhere to the exterior of the tubes contained in array 43 to thus disrupt the heat transfer to the tubes and also to disrupt the passage of the gas itself through the array.

The superheated steam is then passed to turbine 52A via conduit 55 wherein the steam is used to operate turbine 52A.

The majority of the steam, now at a reduced energy level—which is close to saturated level—, is then condensed to water in water entering the steam generator. Thus steam is passed from turbine 52A to condenser 56 via conduit 57 and to feed water heater 45 via conduits 57 and 58. The steam is converted to liquid water in condenser 56 and the water is then passed to feed water storage vessel 59 via conduit 60. Any water losses incurred in the complete steam cycle just described are adjusted by the addition of make-up water to feed water storage vessel 59 from a source not shown via conduit 61.

Water is passed from feed water storage vessel 59 to feed water heater 45 via conduit 62 wherein it is passed in heat exchange relationship with steam from turbine 52A. Steam used in feed water heater 45 is then passed to condenser 56 via conduit 63.

The temperature of the combustion gas is reduced as it passes along path 26 and transfers heat to superheat steam in heat exchangers 42, 43, 42A and 43A and to heat feed water in heat exchanger 44. It is noted that economizer 44 like primary superheater 42A and primary reheater 43A is a horizontal tubing array. Thus comments concerning exchangers 42A and 43A apply to exchanger 44. It is thus apparent that as the hot gas cools it drops vertically in convection section 40B in a natural circulation pattern.

The movement of the gas through the steam generator along path 26 is assisted by induced draft fan 64. As the combustion gases pass from economizer 44—wherein feed water is heated—along path 26 the final usable heat in the gas is used to heat entering combustion air in air heater 65. Any ash still being carried in the combustion gas is then removed in precipitator 66 which lies in path 26 between air heater 65 and induced draft fan 64. The combustion gases are then forced through stack 67 by fan 64 and vented to the atmosphere.

Air to be used in the combustion process is drawn from the atmosphere via conduit 68 by forced draft fan 69 (such as shown by numeral 22 in FIG. 1) and passed in heat exchange relationship with combustion gas in air heater 65 (such as shown by numeral 24 in FIG. 1). Heated air is then passed via conduits 70, 71, 72 and 73 and introduced into a lower portion of radiation zone 40A (such as burner box 20 described in FIG. 1) wherein it combines with fuel introduced into radiation zone 40A via conduit 74 (such as shown by numeral 16 in FIG. 1) to produce heat, combustion gases and ash. As shown, some air may be combined with the fuel in conduit 74.

Some of the ash produced in radiation zone 40A immediately settles to the lowest portion of the zone, identified by numeral 75 (such as slag tank 38 as shown in FIG. 1) from where it is removed by well known methods.

Some ash produced in radiation zone 40A settles in the lowest portion of convection zone 40B, identified by numeral 76, and some is trapped in precipitator 66 from which locations the ash is removed by well known methods.

The balance of the ash produced in radiation zone 40A becomes trapped between the tubing rows in the tubing arrays identified previously as secondary superheater 42 and final reheater 43, each of which are vertical arrays, and primary superheater 42A, primary reheater 43A and economizer 44, each of which are horizontal arrays.

For reasons previously stated, the removal of the trapped ash which, in extreme cases, can virtually completely plug the arrays, is of primary importance and is the subject of this invention.

Turning now to FIG. 2 and FIG. 2A, there is depicted, in extremely simplified form, a vertical tubing array 77 exemplary of the tubing arrays identified as secondary superheater 42 and final reheater 43 described in FIG. 1A. These arrays are suspended from the uppermost portion of the radiation section 40A and the convection section 40B in the path of the combustion gas at its highest temperature. These vertical arrays are sometimes called pendent tubes.

Vertical tubing array 77 consists of steam inlet header 78, steam outlet header 79 and a plurality of tubing panels 80, 81, 82, 83, 84, 85, 86, 87 and 88 attached to headers 78 and 79. Referring specifically to FIG. 2 tubing panel 80 is illustrated in a front view as consisting of five individual tubes 89, 90, 91, 92 and 93 each having its inlet connected to inlet header 78 and its outlet connected to outlet header 79. For purposes of this description the remaining panels of tubing array 77 are identical to panel 80.

As seen in FIG. 2 the flow of combustion gas along path 26 across tubing array 77 is substantially perpendicular to the vertical axis of and parallel to the planes of the tubing panels. Ash carried in the combustion gas separates therefrom, settles and becomes lodged in the spaces between each tube in each panel and in the space between each panel. As time goes on the accumulation of ash can be become so severe that all the spaces within the array becomes substantially completely plugged with ash thus severely impeding gas flow and creating an insulative layer diminishing satisfactory heat transfer from the gas to the steam within each tube.

Figure 4:
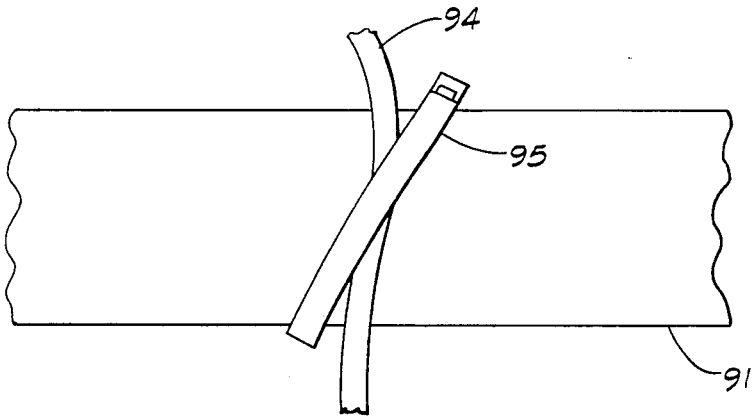
FIG. 4 is a detail view of an explosive detonating cord attached to an individual tube by a disposable mechanical connector.

To separate ash from a vertical tubing array in accordance with this invention a continuous segment of explosive detonating cord 94 is placed immediately adjacent the exterior surface of at least one tube in each tubing panel in the tubing array. FIG. 2 thus shows tubing panel 80 in tubing array 77 having detonating cord 94 placed immediately adjacent the exterior surface of tube 91. Because panel 80 is U-shaped cord 94, being highly flexible in nature, is shown to extend vertically from the extreme upper most portion of panel 80 at headers 78 and 79 to the extreme lower most portion of panel 80 at the horizontal portion of tube 93. Detonating cord 94 is preferably pulled taut, to avoid any slack in the cord, and it is fastened to maintain the taut condition at the upper and lower portions of each vertical leg of cord 94 by a disposable mechanical connecter 95, such as a ty-wrap which is a commercially available item. FIG. 4 illustrates a ty-wrap 95, fastening cord 94 to tube 91.

It is believed to be critical to obtain the desired result of this invention—complete separation of ash from a tubing panel—that the detonating cord be placed in a substantially vertical position on each tubing panel; that it be placed immediately adjacent the exterior surface of a tube; that the cord substantially extend the full vertical dimension of the panel; and that the cord be fastened securely at the uppermost and lowermost level of the panel.

Ash that is very thick may be required to be punctured with a rod so as to produce a hole or tunnel adjacent the exterior surface of the panel into which detonating cord 94 is threaded in order to achieve this desired placement of the cord immediately adjacent the exterior surface of a tube.

It should be appreciated that the placement of continuous segments of detonating cord on each of panels 81–88 inclusive of tubing array 77 shall be as described for panel 80.

Notice in FIG. 2A that the explosive initiation terminus of each explosive detonating cord is connected to a detonator. Each detonator is connected one to another in series by a detonation train. Accordingly, detonating cord 94 is connected to detonator 96; detonating cord 97 is connected to detonator 98; detonating cord 99 is connected to detonator 100; and so on to detonating cord 111 being connected to detonator 112. Detonator 96 is connected to detonator 98 by fuze 113; detonator 98 is connected to detonator 100 by fuze 114; detonator 100 is connected to detonator 102 by fuze 115; and so on to detonator 110 being connected to detonator 112 by fuze 120. Fuze 121 is not required if detonating cord 111 is the last explosive to be detonated in a given shot sequence. If a new shot sequence of explosives is to be immediately initiated in a different tubing array upon the completion of the shot sequence in tubing array 77 then fuze 121 may be used to initiate the new sequence and so on. The detonation train referred to above is the combination of fuzes 113 to 120 (or 121) and detonators 98 to 112. The detonation train and its operation will be further discussed in connection with FIG. 2B which is a detail of detonators 96, 98 and 100 and the associated detonating cords and fuzes.

In overall operation the detonation of explosive detonating cords 94–111 inclusive proceeds in a preset sequence starting with cord 94 and ending with the detonation of detonating cord 111. Each cord in the sequence detonates at a separate time in the order of the preset sequence with a preselected delay between each separate detonation.

Considering tubing panel 80, FIG. 2, upon the initiation of detonator 96 by initiating line 122 detonator 96, cord 94 and fuze 113 all explode simultaneously. Explosive cord 94 which consists of a small continuous core of high explosive surrounded by multiple layers of various materials detonates in a wave beginning at detonator 96 with the detonation wave proceeding to the terminus of the cord at a very high velocity. For example, the high explosive utilized may be PETN or RDX each of which detonates at a rate of about 25000 feet per second or greater. One manufacturer of explosive detonating cord useful herein is Ensign-Bickford of Simsbury, Conn., under the trademark Prima Cord.

Figure 2B:
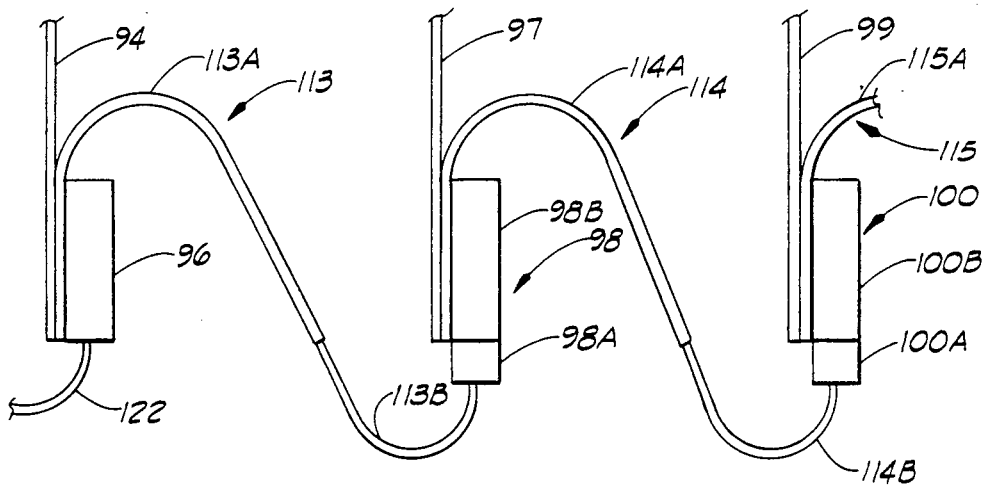
FIG. 2B is a detail of a portion of FIG. 2A illustrating connections between adjacent explosive detonating cords, and the means of detonation of each cord.

The detonation of each cord and the delay between each detonation is described with reference to FIG. 2B which is a detail of FIG. 2A. Referring now to FIG. 2B lead-in line 122 is shown to be directly connected to detonator 96. Explosive detonating cord 94 (see FIG. 2A) and fuze 113 are directly attached by tape (not shown) to detonator 96. Fuze 113 consists of detonating cord 113A directly attached by tape (not shown) to signal tube 113B. Signal tube 113B is directly connected to non-electric delay detonator 98 which consists of delay 98A and detonator 98B.

Lead-in line 122 is an explosive but contains a very small grain load of explosive powder. Line 122 is also known as a noiseless lead-in line and may be initiated by non-electric means such as a shot gun primer. Detonator 96 is a commercially available high explosive detonator used for the detonation of detonating cord. Detonating cord 94 was previously described and is the cord relied upon to separate ash from tubing. Cord 113A is an explosive detonating cord having a grain loading of about 18 grains per foot; it is directly connected to signal tube 113B which, like line 122, contains a very low load of explosive powder. Signal tube 113B is directly connected to delay 98A which contains a pyrotechnic material as contrasted with an explosive.

In operation, line 122 is detonated which causes the immediate detonation of detonator 96, cord 94, cord 113A and signal tube 113B and initiates the burning of delay 98A. Delay 98A burns for a predetermined amount of time equal to the time for over-pressure (hereinafter defined) created by the detonation of cord 94 to dissipate. Upon termination of the pyrotechnic burn detonator 98B, cord 97, cord 114A and signal tube 114B detonates and delay 100A begins to burn. This process is repeated until all the cord connected to the detonating train has exploded. Delays 98A and 100A useful herein have been 250 millisecond and 500 millisecond delays, however other delay times are available and as explained below delay time is set by the time required for over pressure to dissipate.

The combination of detonator 98B, delay 98A and signal tube 113B is commercially available from Ensign-Bickford and is called a Nonel detonator.

Turning now to FIGS. 3, 3A and 3B, there is depicted, in extremely simplified form, a horizontal tubing array 123 exemplary of the tubing arrays identified in FIG. 1A as primary superheater 42A, primary reheater 43A and economizer 44. Tubing array 123, as shown in a front view in FIG. 3, consists of a plurality of tubing panels, three of which are designated by numerals 124,125 and 126. The array is suspended from the uppermost portion of convection section 40B by a plurality of spacers which, due to their large number, are all designated by the numeral 127. To simply the drawings, spacers 127 are all shown but not all numbered in FIG. 3A and are not shown at all in FIG. 3B.

Tubing panels 124, 125 and 126, as seen in FIG. 3, consist of continuous tubes 128, 129, 130, 131 and 132 each connected at its inlet to inlet header 133 and each connected at its outlet to outlet header 134.

Each tubing panel in array 123 has a vertical portion, designated generally by the numerals 135 and 136 in FIG. 3, as connecting panels 124, 125 and 126. The placement and detonation of explosive detonating cords on sections 135 and 136 can conveniently be conducted as described above in connection with FIG. 2.

The combustion gas flow along path 26 across horizontal tubing array 123 is shown in FIGS. 3 and 3B to be vertically down, and parallel with the vertical axis of this array and parallel with the tubing panels in the array.

Also shown in FIG. 3 are explosive detonating cord segments 137, 138, 139, 140, 141, 142, 143, 144, 145, 146 and 147. Also seen in FIG. 3 are fuzes 148 and 149 connecting detonating cords 139 and 141 and 143 and 144 respectively.

FIG. 3A is a top view of FIG. 3 showing panels 124, 150, 151, 152, 153, 154, 155, 156 and 157. For purposes of this description panels 150–157 and those panels directly beneath them (not shown) are identical to the combination of panels 124, 125 and 126 described above.

As is the case with respect to the vertical tubes, ash carried in the combustion gas across the horizontal arrays separates therefrom, settles and becomes lodged in the spaces between each tube in each panel and in the space between each panel. As time goes on the accumulation of ash can become so severe that all the spaces within the array becomes substantially completely plugged with ash thus severely impeding gas flow and creating an insulative layer diminishing satisfactory heat transfer from the gas to the steam within each tube.

To separate ash from a horizontal tubing array in accordance with this invention, continuous separate segments of explosive detonating cord are placed immediately adjacent the exterior surfaces of tubes in each panel as shown by cords 137, 138, 139, 140, 141, 142, 143, 144, 145, 146, 147, 158, 159, 160, 161, 162, 163, 164, 165 and 166. Notice, as seen in FIG. 3B, that each detonating cord segment extends vertically from the uppermost portion of a panel to the lowermost portion of a panel.

For example, detonating cord 158 is seen to wrap completely around tubing panels 152 and 153 and extends the full vertical dimension of each panel. Furthermore, notice that cord 158 is taut and is joined at point 167 by tape (not shown). Upon detonation of detonating cord 158 at point 168, as will be later described, the entire cord 158 explodes and produces a pressure wave, as described below, that proceeds from point 168 in two directions toward point 167. The joining of the ends of cord 158 at point 167 prevents the cord ends from whipping under the influence of the pressure wave and perhaps coming into contact with another cord to thus cause premature detonation. Such premature detonation would not only interrupt the planned explosive sequence, but may cause the simultaneous detonation of too much explosive and produce undesired over pressure.

Cord 158 is placed at a distance from spacer 127. The spacers add sufficient rigidity to the tubing panels so that high energy shock induced, for example, by the explosion of detonating cord 158 may be dissipated too quickly if the explosive is positioned too close to a spacer. It is believed that a distance of about 12 inches is sufficient to avoid excessive dissipation of explosive energy.

The distance between each separate segment of explosive detonating cord is a function of the working space of the cords as described below.

The detonation of the explosives shown in horizontal array 123 begins at detonating cord 137 and proceeds in sequence as follows:

The initiation of lead-in line 169, identical to line 122 as described above, detonates substantially simultaneously detonator 170, detonating cord 137, detonating cord 171, detonating cord 168 and fuze 172; after a preset delay detonator 173 detonates and causes the substantially simultaneous detonation of detonating cord 159, detonating cord 174, detonating cord 160 and fuze 176. In similar fashion cords 161, 140, 138, 162, 163, 164, 165, 166 and 139 all detonate in response to the delay caused by detonators 177, 181, 185, 188 and 192 respectively.

The description and operation of the detonators shown in FIG. 3A (170, 173, 177, 181, 185, 188 and 192) is identical to the description of elements shown is FIG. 2B.

The detonations at junctions 168, 175, 179, 183, 193 and 190 are caused by direct contact between detonating cords 171 and 158, 174 and 160, 178 and 140, 182 and 162, 186 and 164, and 189 and 166 respectively. Crossing one cord with another is sufficient to transfer detonation energy from the detonation train, e.g., 171/172, to detonation cord 168 and so forth.

The discussion concerning vertical arrays with regard to the critical and important aspects of cord placement to achieve ash separation apply with equal importance to horizontal arrays.

The exploding detonating cord creates a moving pressure wave which acts in a 360° arc surrounding the cord. The effective diameter of the wave, herein referred to as the working space, is a function of the weight of explosive per unit length of cord, or grain loading. The grain loading of a detonating cord utilized to separate ash from a given tubing panel determines the force produced by the explosive; tubing can be damaged if the explosive force is too great; grain loading is thus a function of the wall thickness of tubing to which the cord is attached. Cords having a grain loading in the range of from about 70 grains per foot to about 100 grains per foot are believed to be useful to separate ash from tubing according to this invention. With the above principles in mind, it is believed that a detonating cord having a grain loading of about 100 grains per foot can effectively separate ash from tubing having a wall thickness of about 0.200 inches without damaging the walls of the tubing. A 70 grain cord is believed to have an effective working space of about 36 inches and a 100 grain cord is believed to have an effective working space of about 48 inches. Accordingly, the distance between each vertical detonating cord can be roughly equal to the working space of the cord itself.

The pressure wave moving as it does in the vertical direction, is believed to have a great deal to do with the separation of ash from tubing. The explosion also delivers a high-energy shock to the tubes in the panel inducing vibrations in the panel of sufficient intensity to separate ash from tubing. The total mass of explosive which may be detonated at any one time, which is the product of grain loading and length of cord, is a function of the maximum allowable pressure within the steam generator and is thus a function of the volume of the steam generator. Thus, the force produced by the explosive, which is a function of grain loading, must not be great enough to damage tubing and the pressure produced by the explosion, which is a function of the total mass of explosive, must not be great enough to over pressure the walls of the steam generator structure. The delay between each separate detonation of explosive must be sufficient to permit pressure produced by the immediately preceding detonation to substantially completely dissipate.

We believe that over-pressures produced by the detonation of a given mass of explosive utilized in this invention should be maintained at a level no greater than about 5 psi and preferably no greater than about 0.5 psi. We believe that the over-pressure can be dissipated over a time period in the range of from about 0.025 seconds to about 0.500 seconds. Accordingly, the delay between each separate detonation of each separate segment of detonating cord is in the range of from about 0.0250 seconds (250 milliseconds) to about 0.500 seconds (500 milliseconds).

Figure 5:
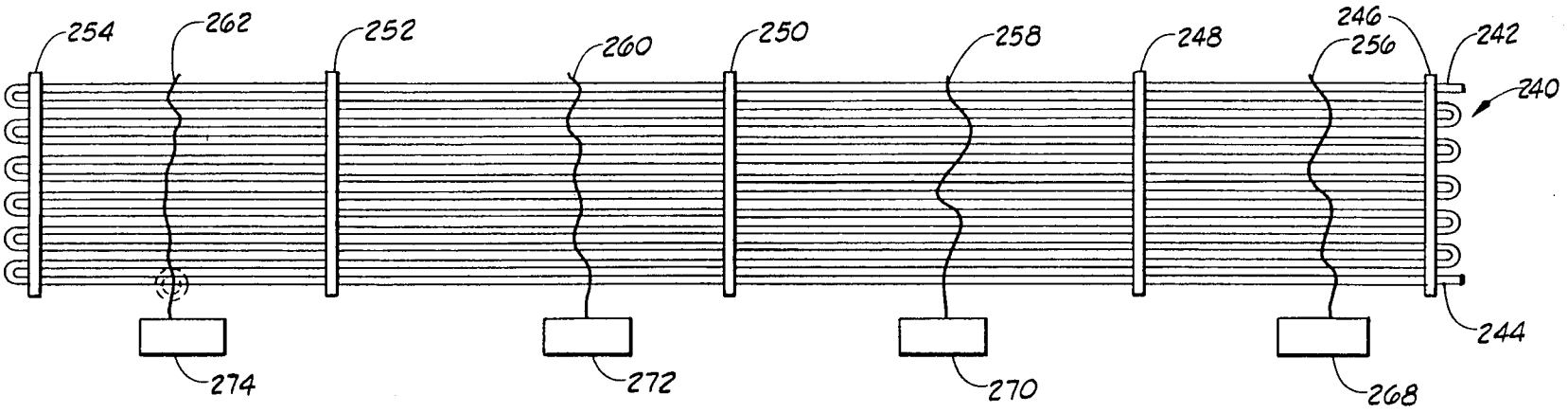
FIG. 5 illustrates a side view of a horizontal tubing panel containing a single tube with a series of explosive detonating cords affixed thereto.

Referring now to FIG. 5, a side view of a horizontally disposed tubing panel is illustrated. The illustrated panel 240 is a simplified representation of one of the tubing panels contained within the primary superheater 32 or economizer 34. The panel 240 includes a series of tubes disposed in parallel and connected at each end via a series of u-shaped tubes, so as to serially connect each of the parallel tubes to form a continuous stream beginning at an inlet 242 and ending at an outlet for 244. A series of spacers 246, 248, 250, 252 and 254 are disposed along the length of the panel of tubing 240 to add rigidity to the panel and maintain the spacing between each of the tubes. Proper spacing allows for the efficient flow of combustion gas through and around each of the tubes within the panel of tubing 240.

To property clean the build-up of slag on the tubing panel 240 a series of explosive detonating cords 256, 258, 260 and 262 are disposed at preselected locations throughout the boiler, immediately adjacent the exterior surface of the tubing panel 240. In particular, the explosive detonating cords 256, 258, 260 and 262 are placed between each of the spacers 246, 248, 250, 252 and 254 so that when the explosive detonating cords 256, 258, 260 and 262 are detonated each section of the tubing panel 240 is subject to a high-energy shock, inducing a vibration in the tubing panel 240 so as to separate the slag therefrom. As can be seen in FIG. 5, each detonating cord 256, 258, 260, and 262 is arranged generally vertically, and extends along the full vertical dimension of the adjacent portion of tubing panel 240.

The spacers 246, 248, 250, 252 and 254 add sufficient rigidity to the tubing panel 240 that the high energy shock induced by, for example, explosive detonating cord 262 is substantially dissipated before it reaches the section of tubing panel 240 between spacers 250 and 252. Thus, to insure that the high-energy shock is sufficiently large in each section of the tubing panel 240 so as to induce in each section of the tubing panel 240 a vibration sufficient to remove the slag therefrom, the explosive charges 256, 258, 260 and 262 are disposed between each of the spacers 246, 248, 250, 252 and 254.

The explosive detonating cords are commercially available cords, such as those manufactured by Ensign-Bickford of Simsbury, Conn. under the trademark Prima Cord. Explosive detonating cord is extremely flexible and easily intertwined into the tubing panel 240.

To maintain the flexible explosive cords 256, 258, 260 and 262 in their desired position, a series of ty-wraps are disposed about each explosive charge 256, 258, 260 and 262 and one of the tubes within the tubing panel 240. For example, FIG. 4 illustrates an explosive detonating cord 94 connected to a tube 91 via a ty-wrap 95. The ty-wrap can take the form of any of a variety of disposable mechanical connectors that are commercially available.

Referring again to FIG. 5, undesirable overstressing of the tubing panel 240 is prevented by controlled detonation of the explosive cords 256, 258, 260 and 262. Rather than detonating all of the explosive cords 256, 258, 260 and 262 simultaneously, the cords 256, 258, 260 and 262 are detonated at preselected intervals. The actual delay imposed between each detonation is a function of the wall thickness and the size of the entire boiler unit.

Sequential detonation has at least two advantages over simultaneous detonation. First, larger individual charges can be used and, second, sequential detonation introduces a traveling vibration that enhances the cleaning ability of the individual high-energy shocks.

Accordingly, individual detonators 268, 270, 272, 274 are associated with each respective explosive charge 256, 258, 260 and 262. The detonators 268, 270, 272 and 274 are programmable to any of a wide variety of delay times. Thus, as discussed above, the detonators are readily programmable to the preferred delay range of 0.025 to 0.5 seconds. Therefore, for example, the cleaning process begins with detonator 268 igniting explosive cord 256. After, for example, a 0.5 second delay, detonator 270 ignites explosive cord 258, followed at 0.5 second intervals with the detonation of explosive cords 260 and 262. It should be appreciated that this process continues at 0.5 second intervals for all of the explosive cords involved in a single shot.

The individual detonators 268, 270, 272 and 274 can take the form of any of a wide variety of commercially available detonators. Preferably, this method employs the Nonel Detonator also manufactured by Ensign-Bickford at its Simsbury, Conn. location.

Additionally, the explosive force of each explosive cord 256, 258, 260 and 262 is limited by the thickness of the tubing walls. Clearly, it would be undesirable for the explosive cords 256, 258, 260 and 262 to generate a high-energy shock that exceeded the strength of the individual tubes. Accordingly, the desired explosive force of each explosive cord is a function of the tubing wall associated with it, as well as the overall size of the boiler unit. For example, a tubing wall thickness of 0.200 inches is effectively cleaned by a 100 grain Prima Cord charge.

Figure 6:
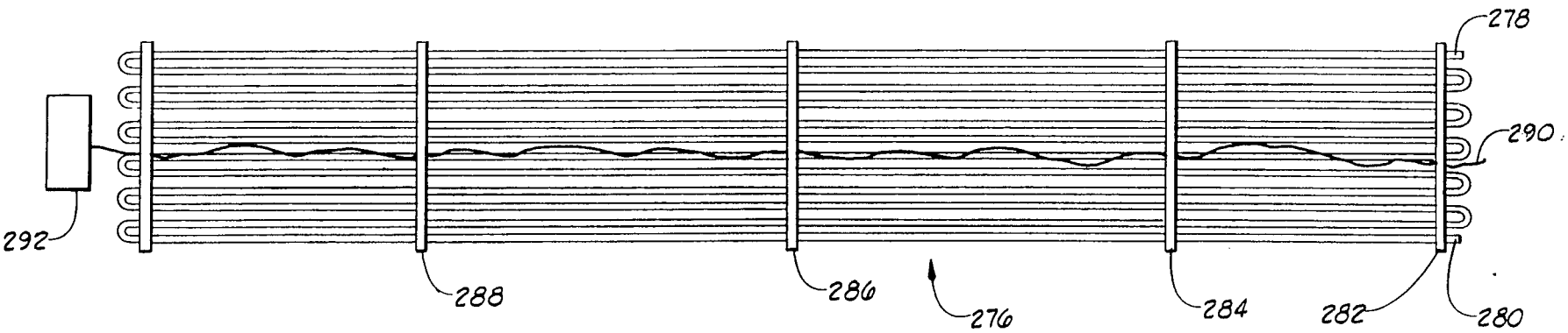
FIG. 6 illustrates a side view of a vertical tubing panel containing a single tube with an explosive detonating cord affixed thereto.

Referring now to FIG. 6, a side view of a vertically disposed tubing panel is illustrated. For example, the illustrated panel 276 is a simplified representation of one of the tubing panels contained within the secondary superheater 28 or reheater superheater 30. The panel 276 is substantially identical to the horizontally disposed tubing panel 240 and includes a series of tubes disposed in parallel and connected at each end via a series of u-shaped tubes, so as to serially connect each of the parallel tubes to form a continuous water path beginning at an inlet 278 and ending at an outlet for 280.

A series of spacers 282, 284, 286 and 288 are disposed along the length of the panel of tubing 276 to add rigidity to the panel and maintain the spacing between each of the tubes. Proper spacing allows for the efficient flow of combustion gas through and around each of the tubes within the panel of tubing 276.

An explosive detonating cord 290 is vertically disposed along the panel 276 and connected thereto at intervals via ty-wraps (not shown) in a substantially similar manner to that discussed in connection with the horizontally disposed tubing panel 240. It should be appreciated that the tubing panel 276 is significantly horizontally wider than is illustrated in FIG. 6. Therefore, additional vertically disposed explosive detonating cords are horizontally spaced apart at substantially the same spacing intervals as discussed in conjunction with tubing panel 240. As with the horizontal tubes of tubing panel 240 of FIG. 5, vertically disposed detonating cord 290 extends generally the full dimension of adjacent tubing panel 276.

Each of the explosive charges 290 has an associated detonator 292 configured to sequentially ignite the charges 290 at the 0.025 to 0.5 second intervals in substantially identical manner to that discussed in conjunction with horizontal tubing panel 240.

Once the ash has been separated from the tubing panels, a manual process of removing the ash is begun. A crew of laborers armed with industrial, dry vacuum equipment pick up the slag/ash that has fallen to the floor of the facility. Also, the slag/ash that has fallen into the slag tank 38 can be removed via the standard operating procedures established by the facility. In some cases removal of the slag/ash from the slag tank 38 is automated, thereby speeding the cleaning process. Typically, the entire cleaning process can be completed by a crew of only four individuals working only 23 hours per day within a 1214 15 day period.

Having described the invention that which is claimed is:

1. A method for separating ash from the exterior surface of tubing located in a stream generator, comprising the steps of:

selecting, within said stream generator, a plurality of tubing locations containing ash to be separated therefrom;

placing an explosive cord adjacent the exterior surface of each of said selected tubing locations, said explosive cord extending in a generally vertical direction and extending proximate the full vertical dimension of said adjacent tubing location;

establishing a sequence of detonation of each said explosive cord; and thereafter detonating said explosive cords wherein each cords are detonated at separate times in the order of said sequence of detonation with a preselected delay between said separate detonations, whereby vibrations are established in said tubing and the ash separates therefrom.

2. The method of claim 1 wherein said preselected delay is not less than about 0.025 seconds.

3. The method of claim 1 wherein said preselected delay is within the range of from about 0.025 seconds to about 0.5 seconds.

4. The method of claim 1, including the steps of determining the wall thickness of said tubing and selecting the explosive force of said explosive cord as a function of the wall thickness of said tubing.

5. The method of claim 1 including the step of removing the ash separated from said tubing.

6. The method of claim 5, wherein the step of removing the ash includes vacuuming the ash.

7. The method of claim 1 wherein said placing step includes attaching said explosive cords adjacent the exterior surface of each of said selected tubing locations.

8. A method for separating ash from the exterior surface of tubing panels located in a steam generator, comprising the steps of:

selecting, within said generator, a plurality of tubing panel locations including ash to be separated therefrom;

placing an explosive cord adjacent the exterior surface of each of said selected tubing panel locations, said explosive cord extending generally vertically, and extending generally the full dimension of said adjacent tubing panel at said tubing panel location; and thereafter detonating all of said explosive cords wherein each said cord is detonated at a separate time with a preselected delay in the range of from about 0.025 seconds to about 0.5 seconds between each said separate detonation, whereby vibrations are established in said tubing panels and the ash separate therefrom.

9. The method of claim 8 wherein said placing step includes attaching each said explosive cord adjacent the exterior surface of each of said selected panel locations.

10. The method of claim 9, including the steps of determining the wall thickness of said tubing panels and selecting the explosive force of said explosive cord as a function of the wall thickness of said tubing panels.

11. The method of claim 10 including the step of removing the ash separated from said tubing panels.

12. The method of claim 11, wherein the step of removing the ash includes vacuuming the ash.

13. A method for removing ash from the exterior surface of tubing panels located in a stream generator, comprising the steps of:

selecting, within said boiler, a plurality of tubing panel locations containing ash to be separated therefrom;

determining the wall thickness of said tubing panels;

selecting the explosive force of explosive cord as a function of the wall thickness of said tubing panels;

attaching said explosive cord adjacent the exterior surface of each of said selected tubing panel locations, said cord extending generally across the vertical dimension of an adjacent tubing panel location;

establishing a sequence of detonation of each said explosive cord; and thereafter detonating all of said explosive cords wherein each said cord is detonated at a separate time in the order of said sequence of detonation with a preselected delay of not less than about 0.025 seconds between each of said separate detonation, whereby vibrations are established in said tubing panels and the ash separates therefrom; and removing the ash separated from tubing panels.

* * * * *

UNITED STATES PATENT AND TRADEMARK OFFICE
CERTIFICATE OF CORRECTION

PATENT NO. : 5,056,587

DATED : October 15, 1991

INVENTOR(S) : Linza J. Jones and Richard N. Willis

It is certified that error appears in the above-identified patent and that said Letters Patent is hereby corrected as shown below:

In column 6, line 40, after "densed to water in", please add --the liquid phase while the balance of the steam is used to pre-heat--.

In column 7, line 68, please delete "be".

In column 10, line 4, "simply" should be --simplify--.

In column 12, line 45, "property" should be --properly--.

In column 14, line 56, "each" should be --said--.

Signed and Sealed this

Twenty-third Day of March, 1993

*Attest:*

STEPHEN G. KUNIN

*Attesting Officer*

*Acting Commissioner of Patents and Trademarks*